US005232103A

United States Patent [19]

Koenig et al.

[11] Patent Number: 5,232,103

[45] Date of Patent: Aug. 3, 1993

[54] HOLDER FOR ELONGATE ELEMENTS

[75] Inventors: Joseph D. Koenig, Palo Alto; David H. Baugher, San Jose, both of Calif.

[73] Assignee: Koenig Associates, Palo Alto, Calif.

[21] Appl. No.: 830,194

[22] Filed: Jan. 31, 1992

[51] Int. Cl.[5] ..... A47F 5/00

[52] U.S. Cl. ..... 211/69.5; 211/60.1; 211/87; 248/205.3

[58] Field of Search ..... 211/60.1, 69.1, 69.5, 211/87, 88; 248/538, 205.3, 512, 513

[56] References Cited

U.S. PATENT DOCUMENTS

| | | | |
|---|---|---|---|
| 1,641,829 | 9/1927 | Shaeffer et al. | 211/69.5 |
| 3,104,778 | 9/1963 | Leonard | 211/60.1 X |
| 3,166,193 | 1/1965 | Rex | 211/69.1 X |
| 3,710,997 | 1/1973 | Asikainen | 211/60.1 X |
| 4,415,092 | 11/1983 | Boyer | 211/60.1 X |
| 4,785,947 | 11/1988 | Avery | 211/69.5 |
| 4,875,591 | 10/1989 | Mikesell | 211/88 X |

*Primary Examiner*—Robert W. Gibson, Jr.

*Attorney, Agent, or Firm*—Flehr, Hohbach, Test, Albritton & Herbert

[57] ABSTRACT

Holder for elongate elements having a back plate lying in a plane with front and rear planar surfaces. A plurality of receptacles are secured to the front planar surface of the back plate in spaced apart positions and generally in alignment. The receptacles have recesses therein extending at an included angle of less than 90° with respect to the front planar surface and are of a size to receive at least one end of an elongate element.

13 Claims, 1 Drawing Sheet

HOLDER FOR ELONGATE ELEMENTS

This invention relates to a holder for elongate elements and more particularly to a whiteboard marker holder.

Markers or pens typically used on whiteboards have tips which are susceptible to drying out, particularly when the tip is not covered. Also, this may occur even if the tip is covered, when the marker or pen is lying in a horizontal position or is lying in an inverted position so that the ink in the marker no longer wicks into the tip of the marker or pen. There is therefore a need for a holder for such markers or pens which will prevent the tips from drying out. There is also a need for holders in other applications, as for example in machine shops for holding elongate elements such as scribing and marking instruments utilized with the machine tools.

In general, it is an object of the present invention to provide a holder for elongate elements.

Another object of the invention is to provide a holder of the above character which is particularly adapted for use with the whiteboard markers.

Another object of the invention is to provide a holder of the above character in which the holder is provided with receptacles which are inclined at an angle in which the included angle is less than 90° .

Another object of the invention is to provide a holder of the above character in which the receptacles are vertically aligned.

Another object of the invention is to provide a holder of the above character which can be affixed to various types of surfaces.

Another object of the invention is to provide a holder of the above character which can be readily manufactured.

Another object of the invention is to provide a holder of the above character which is provided with means for retaining an eraser particularly used in connection with whiteboards.

Additional objects and features of the invention will appear from the following description in which the preferred embodiment is set forth in detail in conjunction with the accompanying drawing.

In general, the holder for elongate elements is comprised of a back plate lying in a plane and having front and rear planar surfaces. A plurality of receptacles are secured to the front surface of the back plate and are mounted in spaced apart positions on the front planar surface of the back plate. The receptacles have recesses extending at an included angle of less than 90° and being of a size to receive at least one end of an elongate element.

Figure 5:
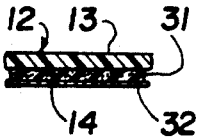
FIG. 5 is a cross-sectional view taken along the line 5—5 of FIG. 4.

More particularly, as shown in the drawing, the holder 11 for elongate elements consists of a back plate 12 which is provided with front and rear planar surfaces 13 and 14. As shown, the plate 12 has a rectangular configuration in plan and has a length which is substantially greater than the width, as for example a width of 1.750" and a length of 8.625". The plate 12 can be formed of a suitable material, as for example plastic. A suitable plastic has been found to be a polycarbonate. The upper corners of the plate can be rounded, as for example by providing a 0.25" radius on the upper corner. Similarly, the side edges can be rounded as shown in cross-section in FIG. 5.

As shown in the drawings, the lower extremity of the plate 12 is provided with a bend 16 to form an upwardly extending lip or ledge 17 which extends at a suitable angle, as for example 45° with respect to the front planar surface 13. The lip or ledge 17 has the same width as the plate 12 and is provided with a planar surface 18 which extends at a suitable angle, as for example 45° with respect to the front planar surface 13. Its outermost extremity is provided with rounded corners as shown. A plurality of reinforcing ribs 19 are provided within the bend 16 with ribs being provided on opposite sides of the plate 12 and another being disposed intermediate the sides of the plate 12.

A plurality of receptacles 21 are secured to the front planar surface 13 in spaced apart positions generally along a longitudinal axis of the back plate 12. As shown, the receptacles 21 have a cylindrical configuration and are in close proximity to each other. However it should be appreciated that, if desired, other configurations, as for example rectangular, can be utilized.

Figure 3:
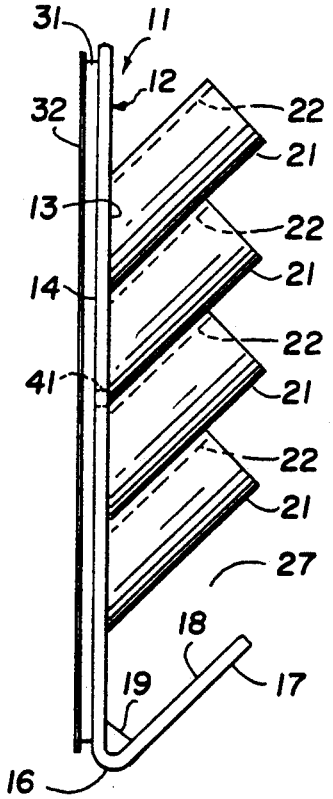
FIG. 3 is a side elevational view of the holder shown in FIG. 1 with the eraser and the markers removed.
Figure 4:
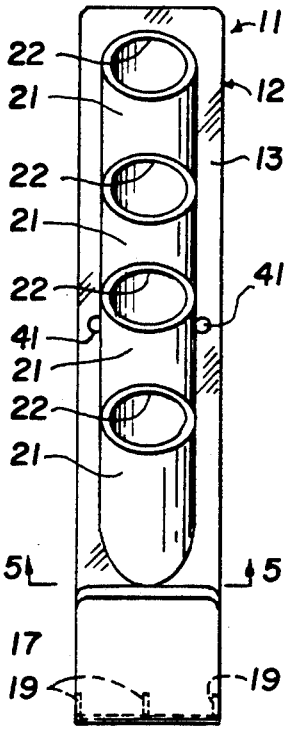
FIG. 4 is a front elevational view of the holder shown in FIG. 1.

The receptacles 21 have recesses 22 therein. As shown, the recesses 22 are also cylindrical in shape. However, again it should be appreciated that, if desired, the recesses could have other configurations, as for example rectangular. The receptacles 21 and the recesses 22 extend at an included angle with respect to the front planar surface 13 which is less than 90°, as for example an angle of 45° as shown in the drawings. The recesses 22 are sized to receive elongate elements of the type to be held or stored therein. For example, the receptacles 21 can have an inside diameter of 0.890" and an outside diameter of 1.040". By providing recesses 22 having such a diameter, elongate elements of various types can be accommodated, as for example markers or pens 26 as shown in the drawings. The receptacles 21 are positioned side by side, as can be seen particularly in FIG. 3.

In the embodiment shown in the drawings, four such receptacles 21 have been provided in which the lowermost receptacle is spaced a predetermined distance from the surface 18 of the lip or ledge 17 to provide a space 27 that can receive a rectangular eraser 27 of a conventional type typically used in connection with whiteboards. The spacing between the surface 18 and the lower surface of the lowermost receptacle 21 providing the space 27 is such so that the eraser 27 is frictionally engaged and retained therein when not in use by the surface 18 on the ledge 17 and the exterior surface of the lowermost receptacle 21.

The plate 12 and the receptacles 21 can be formed of the same plastic material, as for example the polycarbonate hereinbefore described. The material can be provided with a smooth finish and can have a desired color, as for example amber. The holder can be made by having the plate 12 and the receptacles 21 being formed as separate components and then bonding them together by suitable means such as an adhesive. However, it also should be appreciated that the holder preferably should be made in an injection mold to provide a one-piece construction such as that shown in the drawings.

Means is provided for supporting the holder in a desired location and can consist of a double-sided sticky-back or adhesive tape or layer 31 which has one sticky side secured to the rear planar surface 14 and the outer sticky side covered by a protective sheet 32 of a suitable material such as paper. The sheet 32 can be removed when desired to expose the outer sticky side of the layer 31 so that the holder 11 can be secured to the front surface 36 of a conventional whiteboard 37. The whiteboard is mounted in a conventional frame 38 which is provided with a lower horizontal retaining ledge 39. As shown, the holder 11 can be mounted off to one side, as for example the left side of the whiteboard 37. In this position it can be readily used for holding markers 26 and erasers 27 to be utilized with the whiteboard 37.

Figure 1:
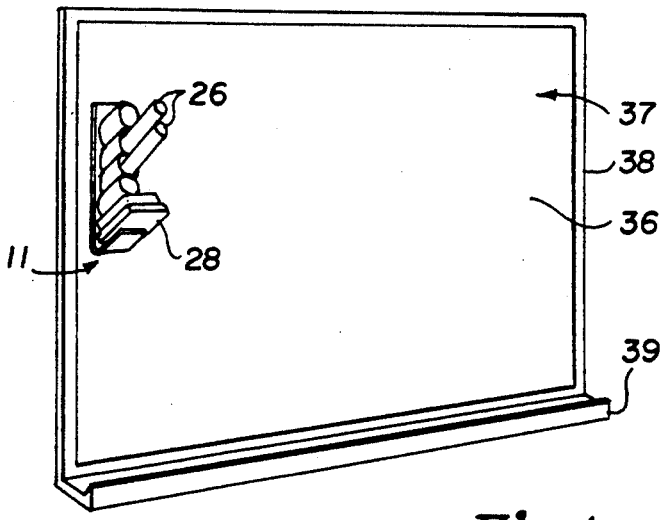
FIG. 1 is an isometric view showing a whiteboard with a holder for elongate elements incorporating the present invention secured to the whiteboard.
Figure 2:
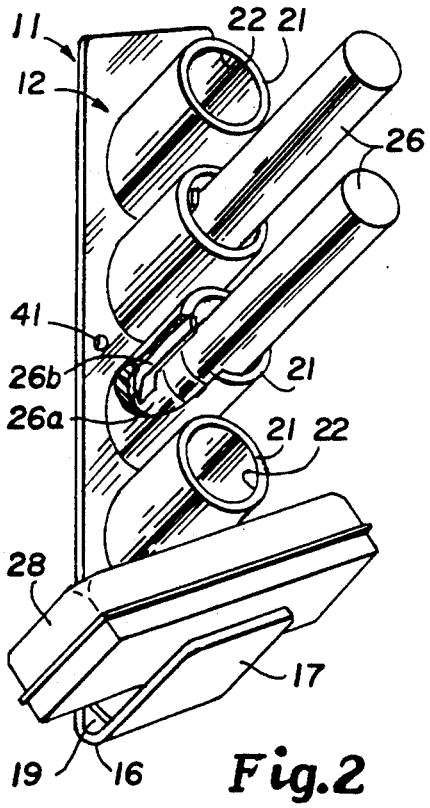
FIG. 2 is an enlarged isometric view of the holder shown in FIG. 1.

In utilizing holder 11 with the whiteboard 37, markers 26 of a conventional type can be utilized which typically have a cap **26*a* and a clip 26*b* (see FIG. 2). When a selected marker is removed from the holder, the cover can be removed from the marker to expose the felt tip (not shown). The marker 26 can then be used to place the desired information upon the whiteboard. After the marker has been utilized, the cap can be replaced over the felt tip and the marker reinserted into one of the recesses 22 with the cap facing inwardly and downwardly so that the liquid within the marker will continuously wet the tip or the wick provided within the marker. In this way, the tip will always be kept wetted and will not dry out. The inclination of the recess ensures that the liquid will always flow downward toward the tip to keep it wetted. In other words, the marker will always be stored in a tip-down orientation. The eraser 27 which is stored in the holder can also be utilized for erasing information placed on the whiteboard. After use of the eraser has been completed, it can be returned to space 27 in the holder and be frictionally engaged between the surface 18 of the ledge 17 and the outer surface of the lowermost receptacle 21. In FIG. 1, the eraser 28 is shown stored in a vertical position and in FIG. 2** it is in a horizontal position.

It should be appreciated that, if desired, the ledge 17 can be utilized for supporting a wiping cloth rather than the eraser 27. It also should be appreciated that although the receptacles 21 have been shown disposed in a vertical orientation, it is possible to arrange the same so that they are horizontally disposed side by side while still having an included angle of less than 90° with respect to the front planar surface 13 so that markers and the like stored therein will still have the proper orientation.

Also, it should be appreciated that if additional receptacles are desired it is merely necessary to place two of the holders 11 side by side.

For other applications of the holder where it may not be possible to utilize the double-sided sticky tape 31, a pair of holes 41 have been provided in the back plate 12 adjacent the vertical side edges of the same. Thus, screws, nails and the like can be utilized for securing the holder to other supports, as for example a wall adjacent the intended location for use of the holder.

Although the holder has thus far been described as being utilized principally for markers for use with whiteboards, it should be appreciated that the holder has many other uses. For example, it can be utilized in machine shops adjacent to machine tools for holding elongate elements such as scribing and writing instruments utilized in connection with the machine tools. For example, with a drill press, the holder can be utilized for holding drill bits. For a lathe, the holder can be utilized for holding marking instruments. Wiping cloths associated with such machine tools can also be hung on the ledge 17.

The holder 11 has been constructed in such a manner that it can be readily and inexpensively fabricated, as for example by injection molding. It also is formed of a material which has an attractive appearance. Its use in connection with a whiteboard is particularly effective in that it lengthens the life of markers by inhibiting their tips from drying out. Also it has been found that the intensity of the color of the ink mark made by the marker is improved. This occurs because the markers are stored tip down in the holder.

What is claimed is:

1. In a holder for elongate elements adapted to be secured to a vertically extending surface, a back plate lying in a substantially vertical plane and having front and rear planar surfaces, a plurality of vertically aligned receptacles secured to the front surface of said back plate in spaced apart positions, said receptacles having recesses therein extending at an included angle of less than 90° with respect to the front planar surface and being of a size to receive at least one end of the elongate element and means carried by the back plate for securing said holder to said vertically extending surface.

2. A holder as in claim 1 wherein said receptacles are disposed along a longitudinal axis.

3. A holder as in claim 1 wherein said receptacles are disposed side by side and at the same angle.

4. A holder as in claim 1 wherein the recesses in said receptacles are disposed at an included angle of approximately 45°.

5. A holder as in claim 1 together with attachment means secured to the rear surface.

6. A holder as in claim 5 wherein said attachment means is in the form of a double-sided sticky back tape having one side engaging the rear planar surface and having the other side covered by a removable flexible sheet of material.

7. A holder as in claim 1 together with at least one hole disposed in the back plate and spaced away from the receptacles.

8. In a holder for elongate elements, a back plate lying in a plane and having front and rear planar surfaces, a plurality of receptacles secured to the front surface of said back plate in spaced apart positions and generally in alignment, said receptacles having recesses therein extending at an included angle of less than 90° with respect to the front planar surface and being of a size to receive at least one end of the elongate element and an inclined ledge formed on the back plate and having a surface extending at an included angle of less than 90° and providing a space with respect to the adjacent receptacle.

9. In a device for use on a writing board having a planar vertically extending writing surface with writing instruments and an eraser for use therewith, a back plate having front and rear surfaces, a plurality of receptacles secured to the front surface of said back plate in spaced apart positions, said receptacles having recesses therein extending at an included angle of less than 90° with respect to the front surface, an inclined ledge secured to the back plate and spaced from a receptacle to provide a space therebetween for frictionally retaining said eraser therein and attachment means secured to the rear surface for securing said back plate to said writing surface.

10. A holder as in claim 9 wherein said receptacles are vertically disposed and are in close proximity to each other.

11. A holder as in claim 10 wherein said plate, said ledge and said receptacles are all formed of the same material.

12. A holder as in claim 11 wherein said material is a plastic.

13. A holder as in claim 12 wherein said plastic is a polycarbonate.

* * * * *